US009175416B2

(12) United States Patent
Fujikata

(10) Patent No.: US 9,175,416 B2
(45) Date of Patent: Nov. 3, 2015

(54) SUBSTRATE HOLDER AND PLATING APPARATUS

(71) Applicant: EBARA CORPORATION, Tokyo (JP)

(72) Inventor: Jumpei Fujikata, Tokyo (JP)

(73) Assignee: Ebara Corporation, Tokyo (JP)

( * ) Notice: Subject to any disclaimer, the term of this patent is extended or adjusted under 35 U.S.C. 154(b) by 231 days.

(21) Appl. No.: 13/752,460

(22) Filed: Jan. 29, 2013

(65) Prior Publication Data

US 2013/0192983 A1 Aug. 1, 2013

(30) Foreign Application Priority Data

Jan. 30, 2012 (JP) ..... 2012-016167

(51) Int. Cl.
*C25D 17/00* (2006.01)
*C25D 17/06* (2006.01)

(52) U.S. Cl.
CPC ..... *C25D 17/06* (2013.01); *C25D 17/001* (2013.01)

(58) Field of Classification Search
CPC .. C25D 17/001; C25D 17/004; C25D 17/007; C25D 17/06; H01L 21/67; H01L 21/673; H01L 21/67346; H01L 21/6735; H01L 21/67353; H01L 21/67369; H01L 21/67376; H01L 21/68; H01L 21/683; H01L 21/687; H01L 21/68707
USPC ..... 204/297.01, 297.14
See application file for complete search history.

(56) References Cited

U.S. PATENT DOCUMENTS

| | | | | |
|---|---|---|---|---|
| 2004/0131766 | A1* | 7/2004 | Katsuoka et al. | 427/98 |
| 2005/0014368 | A1* | 1/2005 | Yoshioka et al. | 438/689 |
| 2012/0043200 | A1* | 2/2012 | Fujikata et al. | 204/242 |

FOREIGN PATENT DOCUMENTS

| | | | |
|---|---|---|---|
| DE | 11-191550 | | 7/1999 |
| JP | 58-91516 | A | 5/1983 |
| JP | 59-31882 | A | 2/1984 |
| JP | 7-6268 | A | 1/1995 |
| JP | 2003-051484 | | 2/2003 |
| JP | 2003-518333 | A | 6/2003 |
| JP | 2004-52059 | A | 2/2004 |
| JP | 2004-76022 | A | 3/2004 |
| JP | 2008-133526 | A | 6/2008 |

* cited by examiner

*Primary Examiner* — Luan Van
*Assistant Examiner* — Alexander W Keeling
(74) *Attorney, Agent, or Firm* — Baker & Hostetler LLP

(57) ABSTRACT

There is provided a substrate holder which can absorb a change in the thickness between substrates and can hold a substrate while preventing deflection of the substrate and keeping the amount of compression of a substrate sealing member within a certain narrow range. The substrate holder includes a first holding member and a second holding member, both for detachably holding a substrate by holding a peripheral portion of the substrate therebetween; and a substrate sealing member, mounted to the second holding member, for sealing the peripheral portion of the substrate along a substrate sealing line. The first holding member has a thickness absorbing mechanism which biases the substrate toward the second holding member at positions along the substrate sealing line.

8 Claims, 9 Drawing Sheets

SUBSTRATE HOLDER AND PLATING APPARATUS

CROSS REFERENCE TO RELATED APPLICATIONS

This document claims priority to Japanese Patent Application No. 2012-016167, filed Jan. 30, 2012, the entire contents of which are hereby incorporated by reference.

BACKGROUND OF THE INVENTION

1. Field of the Invention

The present invention relates to a substrate holder for use in a plating apparatus for carrying out plating of a surface (front surface) to be plated of a substrate, in particular a plating apparatus for forming a plated film in fine interconnect trenches and holes, or resist openings, provided in a surface of a semiconductor wafer, or for forming bumps (protruding electrodes), which are for electrical connection to, e.g., electrodes of a package, on a surface of a semiconductor wafer. The present invention also relates to a plating apparatus provided with the substrate holder.

2. Description of the Related Art

It is common practice, e.g., in TAB (tape automated bonding) or flip chip to form protruding connection electrodes (bumps) of gold, copper, solder or nickel, or of multiple layers of such metals at predetermined portions (electrodes) of a surface of a semiconductor chip, having interconnects formed therein, so that the semiconductor chip can be electrically connected via the bumps to electrodes of a package or TAB electrodes. There are various methods usable for the formation of bumps, such as electroplating, vapor deposition, printing and ball bumping. Of these, electroplating, which can form fine bumps and can be performed in a relatively stable manner, is most commonly used as the I/O number of a semiconductor chip increases and the electrode pitch becomes smaller.

Electroplating methods can be classified roughly into a jet method or cup method in which a substrate, such as a semiconductor wafer, is held in a horizontal position with a surface to be plated facing downwardly, and a plating solution is jetted upwardly onto the surface to be plated, and a dip method in which a substrate is held in a vertical position in a plating tank, and a plating solution is injected upwardly into the plating tank and the plating solution is allowed to overflow the plating tank during plating. Electroplating using a dip method has the advantages of a small footprint and good release of bubbles which adversely affect the quality of plating, and is therefore considered suited for bump plating in which plating is performed for relatively large-sized holes and which requires a considerably long plating time.

A common conventional electroplating apparatus using a dip method, which has the advantage of good release of bubbles, is provided with a substrate holder which detachably holds a substrate, such as a semiconductor wafer, with its front surface (surface to be plated) exposed while sealing an end surface and a back surface of the substrate. The substrate holder, together with a substrate, is immersed in a plating solution in carrying out plating of the surface of the substrate.

With the recent development of those devices and packaging processes which use plating, there is a need to process not only a semiconductor wafer having a standard thickness (775 μm) but also substrates having various diameters. A demand therefore exists for the development of a substrate holder suitable for limited production of diversified products in which processing of substrates having various diameters is required.

A substrate holder, which is to be immersed in a plating solution, needs to securely seal a periphery and a back surface of a substrate so that the plating solution will not enter the back surface of the substrate when the substrate holder holds the substrate. The applicant has proposed a substrate holder for detachably holding a substrate between a first holding member (fixed holding member) and a second holding member (movable holding member) while pressing a substrate sealing member (inner sealing member), mounted to the second holding member, against a peripheral portion of the substrate to seal the contact portion and pressing a holder sealing member (outer sealing member), mounted to the second holding member, against the first holding member to seal the contact portion (see, e.g., patent documents 1 and 2).

In such a substrate holder, the amount of compression of a substrate sealing member for pressing on and sealing a peripheral portion of a substrate changes with the different thickness of the substrate. When the amount of compression of the substrate sealing member is small, there is a fear of leakage of a plating solution. When the amount of compression of the substrate sealing member is large, there is a fear of breakage of a substrate, sticking of the substrate sealing member to a substrate, etc. Further, a change in the thickness of a substrate leads to a change in the contact force on a substrate of an electrical contact which, when the substrate is held by the substrate holder, makes contact with the substrate to supply electricity to the substrate. A small contact force of the contact on a substrate results in a large contact electrical resistance upon supply of electricity to the substrate, whereas a large contact force of the contact on a substrate can cause a scratch in the substrate.

A substrate holder for detachably holding a substrate while absorbing variation (change) in the thickness among substrates has been proposed which includes a leaf spring, disposed in a recess provided in the substrate holder, for biasing a substrate in a direction away from the recess (see patent document 3). To dispose a plate between the leaf spring and a substrate has also been proposed (see patent document 4). A substrate holder has been proposed in which a substrate is pressed against a jig by the biasing force of a spring to obtain a sealing force of a sealing member, mounted on the jig, on a peripheral portion of the substrate (see patent document 5). A substrate holder has been proposed in which a substrate, supported by a support plate, is pressed against a sealing member by the biasing force of a compression spring so that the amount of compression of the sealing member upon pressure contact with a peripheral portion of the substrate is substantially constant regardless of the thickness of the substrate (see patent document 6). A substrate holder has also been proposed which is configured to be capable of applying a constant pressing load, without an adjustment, to a substrate from the back surface by means of a pressing member which is pressed by the biasing force of a compression spring (see patent document 7).

PRIOR ART DOCUMENTS

Patent document 1: Japanese Patent Laid-Open Publication No. 2004-52059

Patent document 2: Japanese Patent Laid-Open Publication No. 2004-76022

Patent document 3: Japanese Patent Laid-Open Publication No. S58-91516

Patent document 4: Japanese Patent Laid-Open Publication No. S59-31882

Patent document 5: Japanese Patent Laid-Open Publication No. H7-6268

Patent document 6: Published Japanese Translation No. 2003-518333 of the PCT International Publication Patent document 7: Japanese Patent Laid-Open Publication No. 2008-133526

SUMMARY OF THE INVENTION

As described above, a variety of substrate holders have been proposed which use the biasing force (spring force) of a leaf spring, a compression spring or the like to absorb variation in the thickness among substrates or respond to a change in the thickness between substrates. Such substrate holders, however, take no measures against the problem that due to the biasing force of a spring, produced when a substrate is held by a substrate holder, a moment acts on the substrate with a sealing member as a fulcrum, which may cause deflection of the substrate. It is, therefore, conceivable that when a substrate is held by such a substrate holder, a considerably large deflection can be produced in the substrate especially when the substrate is a large-sized one.

The present invention has been made in view of the above situation. It is therefore an object of the present invention to provide a substrate holder which can absorb a change in the thickness between substrates and can hold a substrate while preventing deflection of the substrate and keeping the amount of compression of a substrate sealing member within a certain narrow range, and to provide a plating apparatus including the substrate holder.

In order to achieve the object, the present invention provides a substrate holder including a first holding member and a second holding member, both for detachably holding a substrate by holding a peripheral portion of the substrate therebetween; and a substrate sealing member which is mounted to the second holding member and which, when the substrate is held by the first holding member and the second holding member, seals the peripheral portion of the substrate along a substrate sealing line. The first holding member has a thickness absorbing mechanism which, when the substrate is held by the first holding member and the second holding member, biases the substrate toward the second holding member at positions along the substrate sealing line in order to absorb a change in the thickness between substrates.

According to the substrate holder, a change in the thickness between substrates can be absorbed by the thickness absorbing mechanism. In particular, substrates having different thicknesses can each be held by the substrate holder while keeping the amount of compression of the substrate sealing member within a certain narrow range despite the difference in the thickness between the substrates. Furthermore, the use of the thickness absorbing mechanism, which biases a substrate toward the second holding member at positions along the substrate sealing line, can prevent a moment from acting on the substrate, held by the substrate holder, with the substrate sealing member as a fulcrum and causing deflection of the substrate.

In a preferred aspect of the present invention, the first holding member includes a support base and a movable base provided separately from the support base and having a support surface for supporting the substrate held between the first holding member and the second holding member; and the thickness absorbing mechanism comprises the movable base and a plurality of compression springs disposed along the substrate sealing line and supporting the movable base movably with respect to the support base.

With the provision of the thickness absorbing mechanism which can vary the movement distance of the movable base according to the thickness of a substrate, in particular, increase the movement distance of the movable base, i.e., decrease the distance between the movable base and the support base, with an increase in the substrate thickness, the substrate holder can hold substrates having different thicknesses while keeping the amount of compression of the substrate sealing member within a certain narrow range. Furthermore, deflection of a substrate, held by the substrate holder, can be prevented by allowing the spring forces of the plurality of compression springs to act on the substrate via the movable vase at positions along the substrate sealing line.

Preferably, the first holding member is provided with a base guide mechanism for limiting the movement of the movable base with respect to the support base, said base guide mechanism having a stopper for preventing escape of the movable base from the support base.

The base guide mechanism enables the movable base to move smoothly with respect to the support base while preventing escape of the movable base from the support base by the stopper.

Preferably, the second holding member is provided with a first contact member for contact with the periphery of the substrate, held between the first holding member and the second holding member, to supply electricity to the substrate, while the support base of the first holding member is provided with a second contact member connected to an external power source to supply electricity to the first contact member.

According to this substrate holder, the positional relationship between the first contact member, the second contact member and the periphery of a substrate, in contact with the first contact member, can be kept constant regardless of the thickness of the substrate. This makes it possible to securely supply electricity to the substrate.

Preferably, the movable base of the first holding member is provided with a substrate guide for guiding the peripheral end of the substrate to position the substrate with respect to the movable base.

By positioning a substrate with respect to the movable base by the substrate guide secured to the movable base, and allowing the substrate to move together with the movable base, the substrate can be prevented from interfering with the second holding member.

In a preferred aspect of the present invention, the thickness absorbing mechanism comprises a plurality of extendable pins for contact with the substrate, held by the first holding member and the second holding member, to bias the substrate toward the second holding member at positions along the substrate sealing line.

By contracting the extendable pins according to the thickness of a substrate when holding the substrate, the amount of compression of the substrate sealing member can be kept within a certain narrow range. Furthermore, deflection of the substrate, held by the substrate holder, can be prevented by allowing the biasing forces of the plurality of extendable pins to act on the substrate at positions along the substrate sealing line.

The present invention also provides a plating apparatus comprising any one of the above-described substrate holders, and a plating tank for holding a plating solution therein.

According to the substrate holder of the present invention, a change in the thickness between substrates can be absorbed by the thickness absorbing mechanism. In particular, substrates having different thicknesses can each be held by the substrate holder while keeping the amount of compression of the substrate sealing member within a certain narrow range despite the variation in the thickness between the substrates. This can prevent leakage of a plating solution, breakage of a substrate, etc. Furthermore, the use of the thickness absorbing mechanism can prevent a moment from acting on a substrate, held by the substrate holder, with the substrate sealing member as a fulcrum and causing deflection of the substrate.

DETAILED DESCRIPTION OF THE PREFERRED EMBODIMENTS

Figure 1:
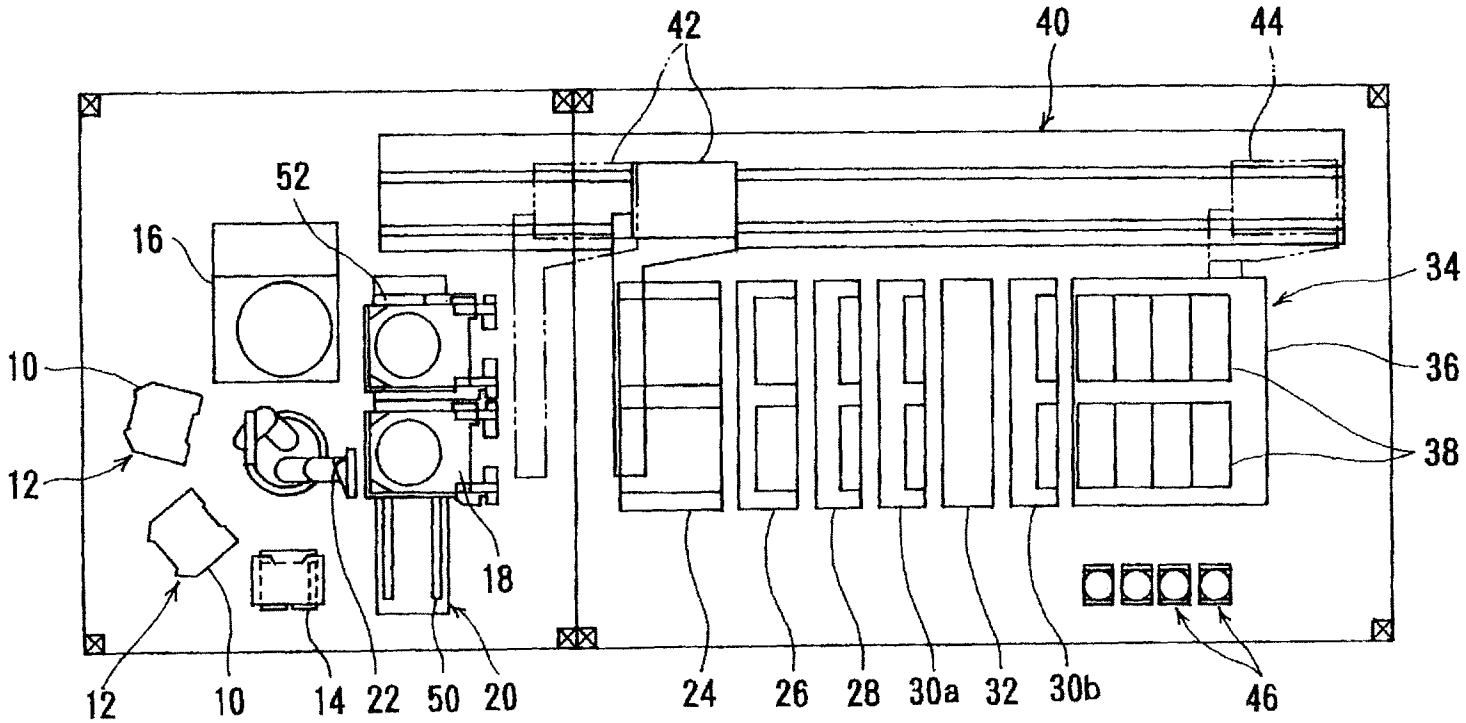
FIG. 1 is an overall layout plan view of a plating apparatus provided with a substrate holder according to an embodiment of the present invention.
Figure 2:
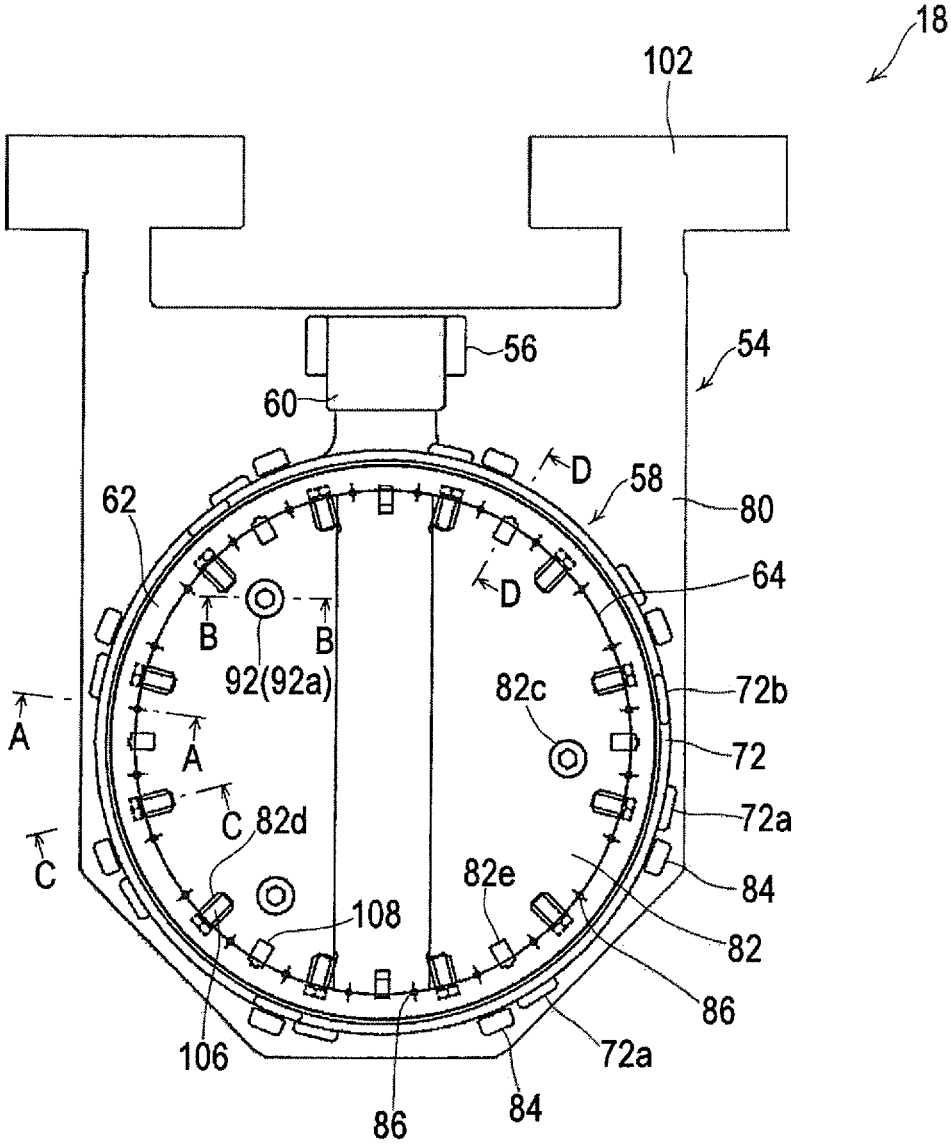
FIG. 2 is a plan view of the substrate holder provided in the plating apparatus shown in FIG. 1.

Preferred embodiments of the present invention will now be described in detail with reference to the drawings. The same reference numerals will be used throughout the drawings and the description to refer to the same or like members, components, etc., and a duplicate description thereof will be omitted.

FIG. 1 shows the overall layout plan of a plating apparatus provided with a substrate holder according to an embodiment of the present invention. As shown in FIG. 1, the plating apparatus includes two cassette tables 12 each mounted with a cassette 10 in which substrates W, such as semiconductor wafers, are housed, an aligner 14 for aligning an orientation flat or a notch of a substrate in a predetermined direction, and a spin drier 16 for drying a substrate after plating by rotating the substrate at a high speed. Near these units is provided a substrate attachment/detachment section 20 for placing a substrate holder 18 thereon, and attaching and detaching a substrate to and from the substrate holder 18. Further, in the center of these units is disposed a substrate transfer device 22 comprised of a transfer robot for transferring a substrate between the units.

The plating apparatus also includes a stocker 24 for temporarily storing substrate holders 18, a pre-wetting tank 26 for immersing a substrate in pure water, a pre-soaking tank 28 for etching away a surface oxide film, e.g., on a surface seed layer of the substrate, a first water-cleaning tank 30*a* for cleaning the surface of the wafer with pure water, a blow tank 32 for draining the substrate after cleaning dry, a second water-cleaning tank 30*b*, and a plating tank 34, which are arranged in this order from the side of the substrate attachment/detachment section 20. The plating tank 34 is comprised of an overflow tank 36 and a plurality of plating units 38 housed in the overflow tank 36. Each plating unit 38 is configured to house one substrate therein and perform plating, e.g., copper plating, of the substrate. Though copper plating is performed in this embodiment, it is also possible to perform plating with nickel, solder, silver or gold.

Located lateral to the above devices, there is provided a substrate holder transport device 40, driven, e.g., by a linear motor, for transporting a substrate holder 18, together with a substrate, between the devices. The substrate holder transport device 40 has a first transporter 42 for transporting a substrate between the substrate attachment/detachment section 20 and the stocker 24, and a second transporter 44 for transporting the substrate between the stocker 24, the pre-wetting tank 26, the pre-soaking tank 28, the water-cleaning tanks 30*a*, 30*b*, the blow tank 32 and the plating tank 34. The substrate holder transport device 40 may be provided with only the first transporter 42 without being provided with the second transporter 44.

On the opposite side of the overflow tank 36 from the substrate holder transport devise 40 is disposed a paddle drive device 46 for driving a paddle (not shown) provided in each plating unit 38 as a stirring rod for stirring a plating solution.

The substrate attachment/detachment section 20 includes a flat pedestal plate 52 which is laterally slidable along rails 50. Two substrate holders 18, parallel to each other, are placed in a horizontal position on the pedestal plate 52. After transferring a substrate between one substrate holder 18 and the substrate transfer device 22, the pedestal plate 52 is slid laterally and a substrate is transferred between the other substrate holder 18 and the substrate transfer device 22.

As shown in FIGS. 2 through 7, the substrate holder 18 includes a first rectangular plate-like holding member (fixed holding member) 54, e.g., made of polyvinyl chloride, and a second holding member (movable holding member) 58 openably and closably mounted to the first holding member 54 via a hinge 56. Though in this embodiment the second holding member 58 is configured to be openable and closable by the hinge 56, it is also possible, for example, to dispose the second holding member 58 opposite the first holding member 54, and to open or close the second holding member 58 by moving the second holding member 58 away from or toward the first holding member 54.

The second holding member 58 includes a base portion 60 and a ring-shaped seal holder 62, and is made of, for example, polyvinyl chloride so that it is slidable with respect to the below-described retainer ring 72. An inwardly-projecting substrate sealing member 66 which, when a substrate W is held by the substrate holder 18, makes pressure contact with a peripheral portion of the substrate W along a substrate sealing line 64 and seals the contact portion, is fixed on a surface, facing the first holding member 54, of the seal holder 62, while an holder sealing member 68 which makes pressure contact with the below-described support base 80 of the first holding member 54 and seals the contact portion at a position outside the substrate sealing member 66 is fixed on a surface, facing the first holding member 54, of the seal holder 62.

The substrate sealing member 66 and the holder sealing member 68 are fixed to the seal holder 62 by sandwiched between the seal holder 62 and a fixing ring 70 which is secured to the seal holder 62 via fastening tools 69 such as bolts. The substrate sealing member 66 has a protruding portion 66*a* which seals the gap between the seal holder 62 and the top of the fixing ring 70.

A peripheral stepped portion is formed in the seal holder 62 of the second holding member 58, and a retainer ring 72 is rotatably mounted to the stepped portion via a spacer 74. The retainer ring 72 is inescapably held by an outwardly projecting retainer plate (not shown) mounted to the side surface of the seal holder 62. The retainer ring 72 is composed of a material having high rigidity and excellent acid corrosion resistance, for example titanium, and the spacer 74 is composed of a material having a low friction coefficient, for example PTEF, so that the retainer ring 72 can rotate smoothly.

The first holding member 54 includes a generally plate-like support base 80 which, when a substrate W is held by the substrate holder 18, makes pressure contact with the holder sealing member 68 to seal the interface with the second holding member 58, and a generally disk-like movable base 82 provided separately from the support base 80. Positioned outside of the retainer ring 72, inverted L-shaped clampers 84, each having an inwardly projecting portion, are disposed on the support base 80 of the first holding member 54 at regular intervals along the circumferential direction. On the other hand, outwardly projecting portions 72*a* are provided on the retainer ring 72 at circumferential positions facing the clampers 84. The lower surface of the inwardly projecting portion of each clamper 84 and the upper surface of each projecting portion 72*a* of the retainer ring 72 are tapered in opposite directions along the rotational direction of the retainer ring 72. A plurality of, for example four, upwardly protruding raised dots 72*b* are provided on the retainer ring 72 in predetermined positions along the circumferential direction. The retainer ring 72 can be rotated by pushing and moving each raised dot 64*a* from the side by a rotating pin (not shown).

Figure 3:
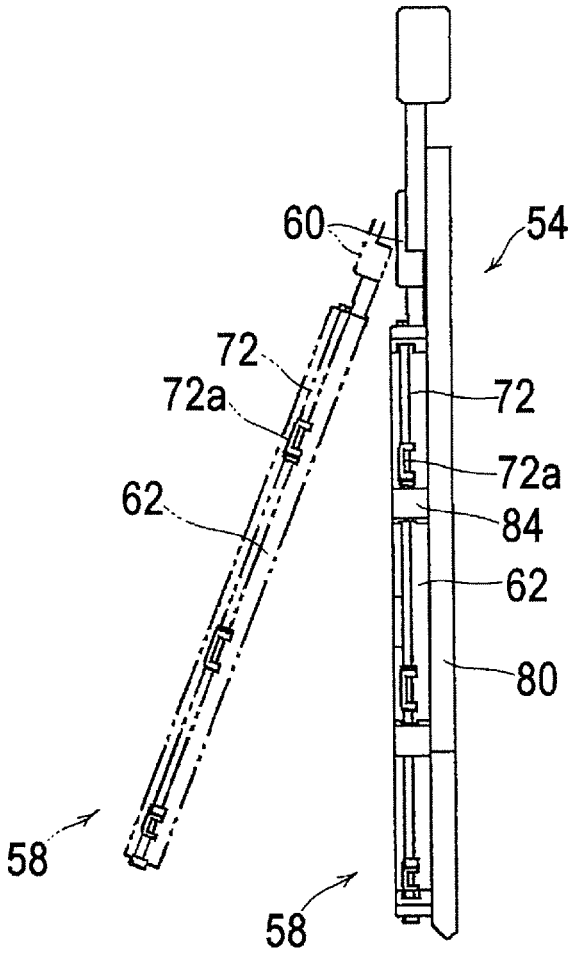
FIG. 3 is a right side view of the substrate holder shown in FIG. 2, illustrating the substrate holder when a second holding member, shown by the imaginary lines, is open.
Figure 4:
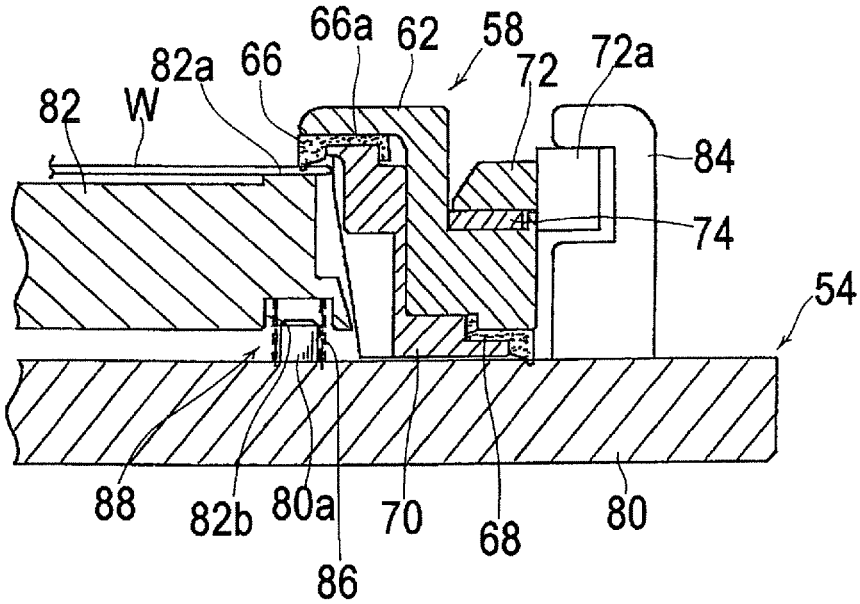
FIG. 4 is an enlarged cross-sectional view taken along the line A-A of FIG. 2.

When the second holding member 58 is open, as shown by the imaginary lines in FIG. 3, a substrate W is inserted into the central portion of the first holding member 54, and then the second holding member 58 is closed by the hinge 56. When the retainer ring 72 is rotated clockwise, each projecting portion 72*a* of the retainer ring 72 slides into the inwardly projecting portion of each clamper 84, and the first holding member 54 and the second holding member 58 come to be fastened to each other and locked by engagement between the tapered surface of each projecting portion 72*a* of the retainer ring 72 and the tapered surface of each clamper 84. The lock can be released by rotating the retainer ring 72 counterclockwise and withdrawing each projecting portion 72*a* of the retainer ring 72 from the inwardly projecting portion of each clamper 84.

The movable base 82 has an annular support surface 82*a* which, when a substrate W is held by the substrate holder 18, makes contact with a peripheral portion of the substrate W to support the substrate W. The movable base 82 is mounted via compression springs 86 to the support base 80 while the movable base 82 is biased in a direction away from the support base 80 and is movable against the biasing forces (spring forces) of the compression springs 86 in a direction closer to the support base 80. The movable base 82 and the compression springs 86 constitute a thickness absorbing mechanism 88 in which the movable base 82 moves toward the support base 80 against the biasing forces (spring forces) of the compression springs 86 for a distance proportional to the thickness of a substrate W held by the substrate holder 18. A change in the thickness between substrates can thus be absorbed.

Thus, when a substrate W is held by the substrate holder 18 by locking the first holding member 54 and the second holding member 58 together in the above-described manner, the lower end of the inner downwardly-protruding portion of the substrate sealing member 66 makes pressure contact with a peripheral portion of the substrate W, held by the substrate holder 18, along the substrate sealing line 64, while the lower end of the outer downwardly-protruding portion of the holder sealing member 68 makes pressure contact with the surface of the support base 80 of the first holding member 54, whereby the sealing members 66, 68 are uniformly pressed and the contact portions are sealed. Upon the holding of the substrate W, the movable base 82 moves toward the support base 80 such that the movement distance varies according to the thickness of the substrate W, i.e., the movement distance increases with the thicker thickness of the substrate W. The thickness absorbing mechanism 88 can thus absorb a change in the thickness between substrates W.

Thus, when a substrate W is held by the substrate holder 18, the distance between the support base 80 and the substrate sealing member 66 is approximately constant regardless of the thickness of the substrate W. On the other hand, as the thickness of the substrate W increases, the deformation (compression) of each compression spring 86 increases to such an extent as to approximately match the increase in the thickness of the substrate W and, accordingly, the distance of movement of the movable base 82 toward the support base 80 increases by the increase in the deformation of each compression spring 86. The amount of compression of the substrate sealing member 66 upon holding of a substrate W, having a large thickness, can therefore be decreased, making it possible to hold the substrate W while keeping the amount of compression of the substrate sealing member 66 within a certain narrow range.

Figure 8:
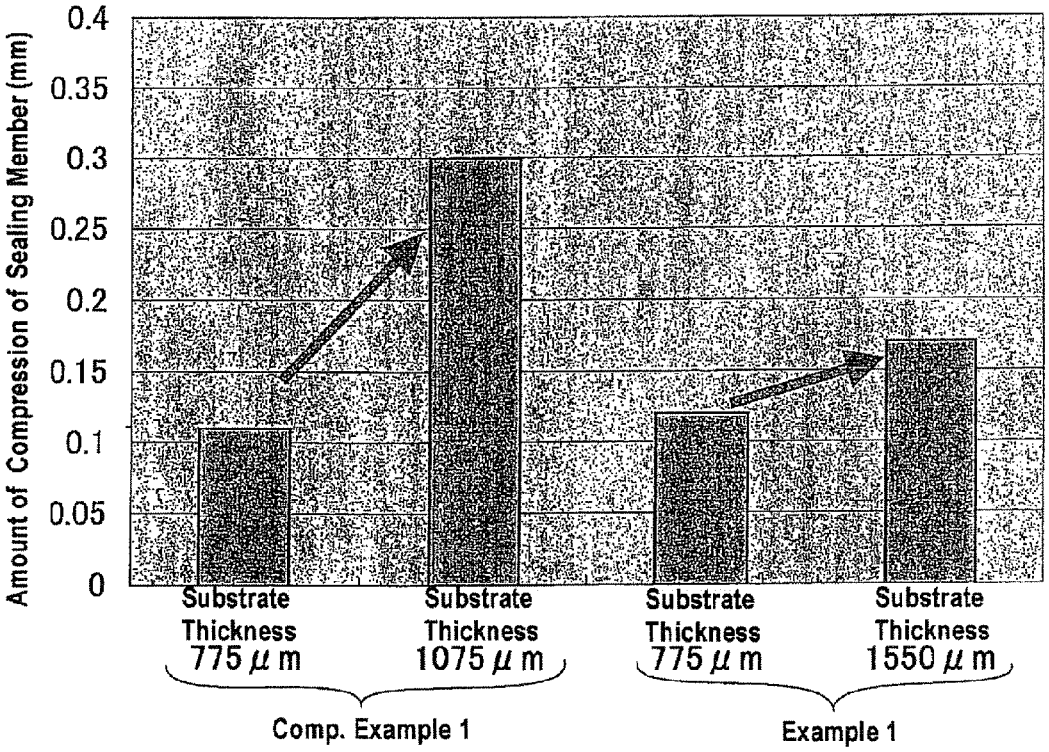
FIG. 8 is a graph showing the amount of compression of a substrate sealing member as observed when a substrate having a thickness of 775 μm or a substrate having a thickness of 1075 μm is held either by a conventional substrate holder having no thickness absorbing mechanism (Comp. Example 1) or by a substrate holder having a thickness absorbing mechanism according to the present invention (Example 1)

For example, as shown in FIG. 8, in a conventional substrate holder having no thickness absorbing mechanism (Comp. Example 1), the amount of compression of a substrate sealing member changes from 0.11 mm to 0.3 mm as the thickness of a substrate, held by the substrate holder, changes from 775 μm to 1075 μm. On the other hand, in the substrate holder 18 of this embodiment (Example 1), having the thickness absorbing mechanism 88, the amount of compression of the substrate sealing member 66 changes from 0.12 mm to 0.17 mm as the thickness of a substrate, held by the substrate holder 18, changes from 775 μm to 1550 μm. Thus, the increase in the amount of compression of the substrate sealing member is significantly lower in the substrate holder according to the present invention despite the larger increase in the thickness of a substrate.

With the provision of the thickness absorbing mechanism 88 which can vary the movement distance of the movable base 82 according to the thickness of a substrate W, in particular, increase the movement distance of the movable base 82, i.e., decrease the distance between the movable base 82 and the support base 80, with an increase in the thickness, the substrate holder 18 can hold substrates W having different thicknesses while keeping the amount of compression of the substrate sealing member 66 within a certain narrow range despite the variation in the thickness between the substrates W.

In this embodiment, a total of 24 compression springs 86 are arranged at regular intervals in positions along the substrate sealing line 64. The distance between the substrate sealing line 64 and the edge of a substrate W is, for example, about 1 to 3 mm. The distance between the edge of a substrate W and a line connecting the centers of the compression springs 86 concentrically with the substrate sealing line 64 is, for example, about 1 to 5 mm. To stabilize the position of each compression spring 86, a projection 80*a*, which is surrounded by a lower portion of each compression spring 86, is provided on the support base 80 at a position to which each compression spring 86 is provided, while a recess 82*b*, into which an upper portion of the compression spring 86 is inserted, is provided in the movable base 82 at a position to which each compression spring 86 is provided.

With the compression springs 86 disposed in positions along the substrate sealing line 64, i.e., on or close to the substrate sealing line 64, the spring forces of the compression springs 86 act on a substrate W, held by the substrate holder 18, via the movable base 82 at positions along the substrate sealing line 64. This can prevent a moment from acting on the substrate W with the substrate sealing member 66 as a fulcrum and causing deflection of the substrate W.

Figure 9:
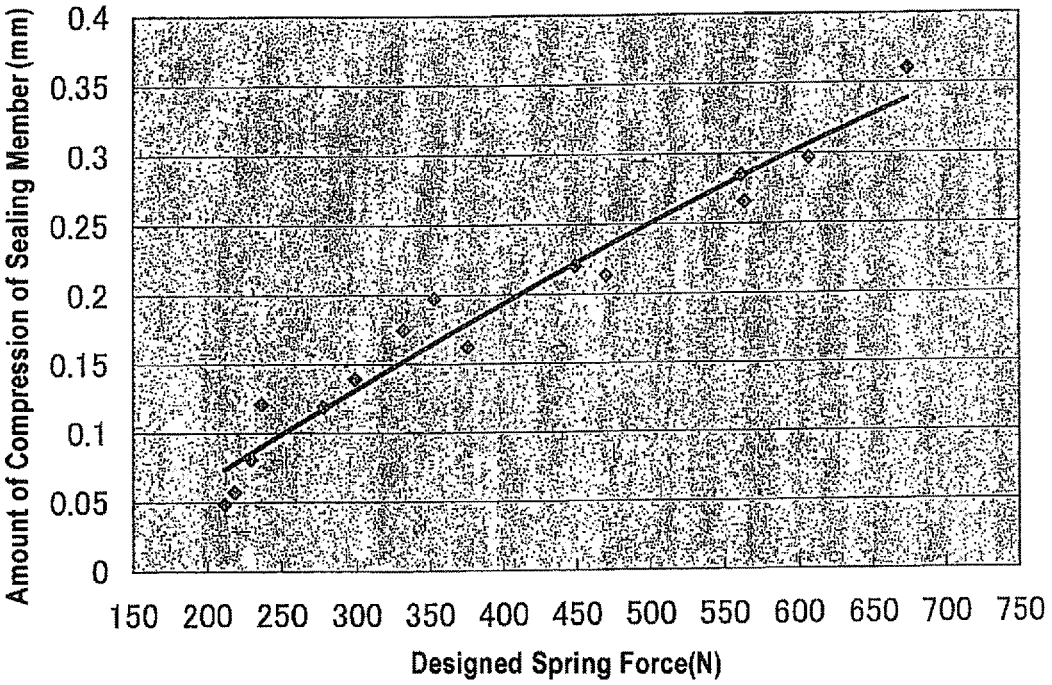
FIG. 9 is a graph showing the relationship between the spring forces (designed spring forces) of compression springs and the amount of compression of a substrate sealing member in a substrate holder according to the present invention.

FIG. 9 shows the relationship between the spring forces (designed spring forces) of the compression springs 86 and the amount of compression of the substrate sealing member 66 in the substrate holder 18 of this embodiment. As can be seen in FIG. 9, the amount of compression of the substrate sealing member 66 increases almost in proportion to the spring forces (designed spring forces) of the compression springs 86. The graphical data in FIG. 9 indicates that in the substrate holder 18 of this embodiment, the amount of compression of the substrate sealing member 66 can be appropriately adjusted by the spring forces of the compression springs 86. An appropriate spring force of the compression springs 86 has been found to be 600 N, e.g., based on the results of a leakage test in which a substrate is immersed in a plating solution.

Figure 5:
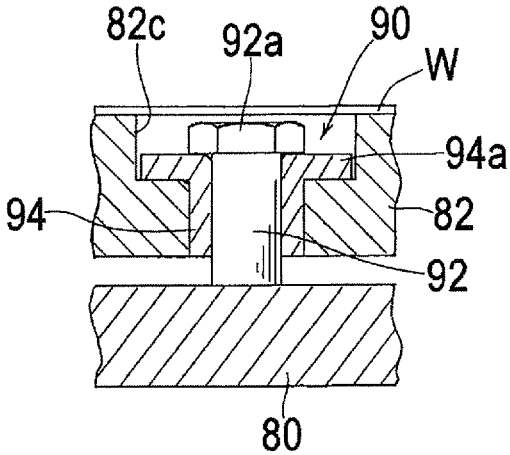
FIG. 5 is an enlarged cross-sectional view taken along the line B-B of FIG. 2.

To move the movable base 82 smoothly with respect to the support base 80, base guide mechanisms 90 are provided between the support base 80 and the movable base 82, as shown in FIG. 5. Each base guide mechanism 90 includes a guide shaft 92, comprised of a bolt in this embodiment, secured to the support base 80, and a generally cylindrical shaft receiver 94 having a flange 94*a*, secured to the movable base 82. The guide shaft 92 is inserted into the shaft receiver 94 and is configured to be movable with the shaft receiver 94 as a guide. The guide shaft 92 is made of, for example, stainless steel, while the shaft receiver 94 is made of, for example, a resin having good lubricating properties. The difference between the inner diameter of the shaft receiver 94 and the outer diameter of the guide shaft 92 is set to 0.05 mm to 0.16 mm so that the movable base 82 will not move laterally with respect to the support base 80.

Though it is desirable to dispose base guide mechanisms 90 in such a manner that one base guide mechanism 90 is disposed in the vicinity of one compression spring 86, three base guide plates 90 are provided in this embodiment in view of the cost and the ease of assembly.

In the substrate holder 18 of this embodiment, the spring force of the compression spring 86 somewhat changes with the thickness of a substrate. In order to minimize the change in the spring force of the compression spring 86, the compression spring 86 used in this embodiment is one which has a low spring constant and to which an initial compression strain is imparted when the movable base 82 is mounted to the support base 80.

In particular, in this embodiment, the head of a bolt constituting the guide shaft 92 is used as a stopper 92*a* and the stopper 92*a* is brought into contact with the flange 94*a* of the shaft receiver 94 by the spring forces of the compression springs 86. This can imparts an initial compression strain to each compression spring 86 while preventing escape of the movable base 82 from the support base 80, and can achieve an appropriate amount of compression of the substrate sealing member 66, e.g., when the movable base 82 is pressed and moved 0.5 mm.

In this embodiment, recesses 82*c* are provided in the surface of the movable base 82; and the stopper 92*a*, i.e., the head of the volt constituting the guide shaft 92, is exposed in each recess 82*c*. This makes it possible to easily attach/detach the movable base 82 to/from the support base 80 by the bolts constituting the guide shafts 92.

Figure 6:
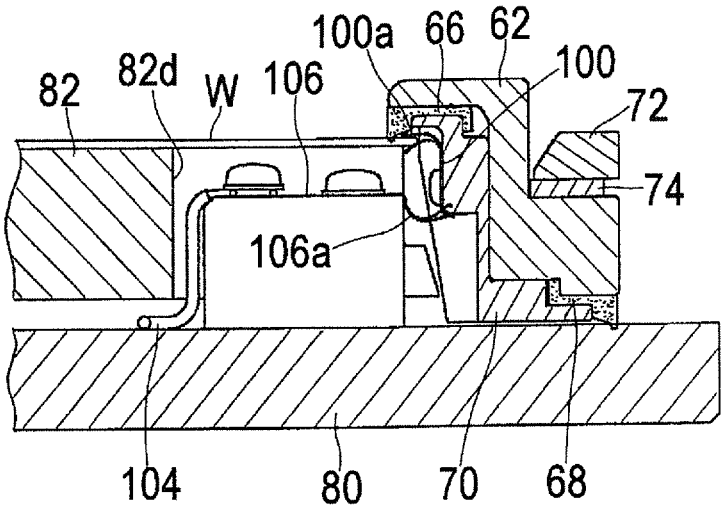
FIG. 6 is an enlarged cross-sectional view taken along the line C-C of FIG. 2.

As shown in FIG. 6, a plurality of first contact members 100 which, when a substrate W is held by the substrate holder 18, make pressure contact with the periphery of the substrate W to supply electricity to the substrate W, are mounted to the inner peripheral surface of the fixing ring 70 of the second holding member 58. The first contact members 100 each have a contact 100*a* projecting inwardly like a leaf spring and lying outside of the substrate sealing member 66. The contact 100*a* of each first contact member 100 is springy and easily bendable by its elasticity and, when a substrate W is held by the substrate holder 18, makes elastic contact with the peripheral surface of the substrate W.

Rectangular cut-out portions 82*d* are provided in a peripheral area of the movable base 82 at positions corresponding to the first contact members 100. Second contact members 106, each connected to a conducting wire 104 extending from an external contact provided in the below described hands 102, are disposed on the support base 80 at positions corresponding to the cut-out portions 82*d*. The second contact members 106 each have a contact 106*a* projecting outwardly like a leaf spring. The contact 106*a* of each second contact member 106 is springy and easily bendable by its elasticity and, when a substrate W is held by the substrate holder 18, makes elastic contact with the first contact member 100. Electricity is thus supplied to the substrate W, held by the substrate holder 18, through the first contact members 100 and the second contact members 106.

When a substrate W is held by the substrate holder 18, the positional relationship between the exposed surface of the substrate W, the support base 80 of the first holding member 54 and the second holding member 58 is constant regardless of the thickness of the substrate W.

By fixing the first contact members 100 to the second holding member 58 and fixing the second contact members 106 to the support base 80 of the first holding member 54, according to this embodiment, the positional relationship between the periphery of a substrate W, in contact with the contacts 100*a* of the first contact members 100, the first contact members 100 and the second contact members 106 can be kept constant regardless of the thickness of the substrate W. Therefore, the contact force between the contact 100*a* of each first contact member 100 and the periphery of the substrate W and the contact force between the contact 106*a* of each second contact member 106 and the first contact member 100 can be kept constant. This makes it possible to securely supply electricity to the substrate W.

Figure 7:
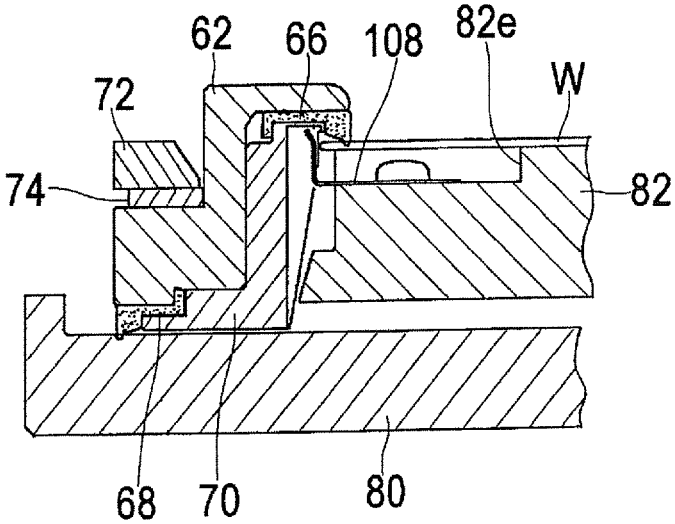
FIG. 7 is an enlarged cross-sectional view taken along the line D-D of FIG. 2.

Rectangular top-open grooves 82*e* are provided in a peripheral area of the upper surface of the movable base 82. As shown in FIG. 7, in each groove 82*e* is provided a substrate guide 108 for guiding the peripheral end of a substrate W to position the substrate W with respect to the movable base 82. When a substrate W is placed on the support surface 82*a* of the movable base 82 prior to holding of the substrate W by the substrate holder 18, the peripheral end of the substrate W is guided by the substrate guides 108 and the substrate W is positioned with respect to the movable base 82.

By thus positioning a substrate W with respect to the movable base 82 by the substrate guides 108 secured to the movable base 82, and allowing the substrate W to move together with the movable base 82, the substrate W can be prevented from interfering with the seal holder 62 of the second holding member 58.

Though not shown diagrammatically, the substrate holder 18 is provided with a centering spring having a centering (positioning) function for a substrate W, and a sticking prevention mechanism which, when a substrate W after plating is taken out of the substrate holder 18, prevents the substrate W from sticking to the substrate sealing member 66 and lifting together. The first contact members 100 may have such substrate centering (positioning) function and sticking prevention function.

The second holding member 58 is opened/closed by a not-shown cylinder and by the weight of the second holding member 58 itself. In particular, a through-hole (not shown) is provided in the first holding member 54, and a cylinder is provided at a position where the cylinder faces the through-hole when the substrate holder 18 is placed on the pedestal plate 52. The second holding member 58 is opened, as shown by the imaginary lines in FIG. 3, by extending a cylinder rod of the cylinder to lift up a pressing rod through the through-hole and thereby push up the seal holder 62 of the second holding member 58. The second holding member 58 is closed by its own weight by retracting the cylinder rod.

To the end of the support base 80 of the first holding member 54 is coupled a pair of generally T-shaped hands 102 which serve as a support during transport of the substrate holder 18 or when the substrate holder 18 is held in a suspended state. In the stocker 24, the outwardly projecting portions of the hands 102 are placed on the upper surface of the peripheral wall of the stocker 24, whereby the substrate holder 18 is suspended in a vertical position. When transporting the substrate holder 18 from the stocker 24, the hands 102 of the suspended substrate holder 18 are gripped by the transporter 42 of the substrate holder transport device 40. Also in the pre-wetting tank 26, the pre-soaking tank 28, the water-cleaning tanks 30*a*, 30*b*, the blow tank 32 and the plating tank 34, the substrate holder 18 is held in a suspended state with the hands 102 placed on the peripheral wall of the tank.

A sequence of plating process steps performed by the thus-constructed plating apparatus will now be described. First, one substrate is taken by the substrate transfer device 22 out of the cassette 10 mounted on the cassette table 12, and the substrate is placed on the aligner 14 to align an orientation flat or a notch in a predetermined direction. After the alignment, the substrate is transported to the substrate attachment/detachment section 20 by the substrate transfer device 22.

On the other hand, two substrate holders 18 housed in the stocker 24 are simultaneously gripped by the transporter 42 of the substrate holder transport device 40, and transported to the substrate attachment/detachment section 20. The substrate holders 18 are lowered in a horizontal position to simultaneously place the two substrate holders 18 on the pedestal plate 52 of the substrate attachment/detachment section 20, and then the cylinder is actuated to open the second holding member 58 of each substrate holder 18, as shown in FIG. 3.

The substrate W is transported by the substrate transfer device 22 to the substrate holder 18 positioned on the center side. The substrate W is placed on the support surface 82*a* of the movable base 82 while the substrate W is guided by the substrate guides 108 and positioned with respect to the movable base 82. Next, the cylinder is reversely actuated to close the second holding member 58, and then the second holding member 58 is locked by the locking/unlocking mechanism. Upon the locking of the second holding member 58, the movable base 82 of the first holding member 54 moves relative to the support base 80 according to the thickness of the substrate W, so that a change in the thickness between substrates W can be absorbed. Further, since no moment acts on the substrate W with the substrate sealing member 66 as a fulcrum, the substrate W will not deflect. After completion of the attachment of the substrate to the one substrate holder 18, the pedestal plate 52 is slid laterally, and a substrate is attached to the other substrate holder 18 in the same manner. Thereafter, the pedestal plate 52 is returned to the original position.

By the above operation, the substrate W is fixed in the substrate holder 18 with its front surface (to be plated) exposed in the opening of the substrate holder 18 and its periphery and back surface sealed with the seal members 66, 68 to prevent intrusion of a plating solution and to allow electrical connection of a sealed portion, not in contact with the plating solution, with the contacts 100*a* of the first contact members 100. Conducting wires from the first contact members 100 are connected to the hands 102 of the substrate holder 18. Therefore, electricity can be supplied to, e.g., a seed layer of the substrate W by connecting a power source to the wire portion of the hands 102. The substrate attachment/detachment section 20 has a sensor for sensing the electrical contact between a substrate W, attached to the substrate holder 18, and the contacts 100*a* of the first contact members 100. When the sensor determines poor contact between a substrate W and the contacts 100*a* of the first contact members 100, the sensor outputs the signal to a controller (not shown).

Next, the two substrate holders 18 loaded with the substrates W are simultaneously gripped by the transporter 42 of the substrate holder transport device 40 and transported to the stocker 24. The two substrate holders 18 are lowered in a vertical position to suspend them in the stocker 24 for temporary storage. The substrate transfer device 22, the substrate attachment/detachment section 20 and the transporter 42 of the substrate holder transport device 40 sequentially repeat the above operations to sequentially attach substrates to substrate holders 18 which have been housed in the stocker 24 and sequentially suspend the substrate holders 18 in predetermined positions in the stocker 24 for their temporary storage.

Though not shown diagrammatically, instead of the substrate attachment/detachment section 20 on which two substrate holders 18 are to be placed in a horizontal position, it is possible to provide a fixing station which supports two substrate holders, which have been transported by the transporter 42, in a vertical position. The substrate holders can be brought into a horizontal position by rotating the fixing station, holding the substrate holders in a vertical position, by 90 degrees.

Though in this embodiment the one locking/unlocking mechanism is provided, it is possible to provide two locking/unlocking mechanisms and to simultaneously perform locking/unlocking of two substrate holders, disposed adjacent to each other, by the two locking/unlocking mechanisms.

Two substrate holders 18 loaded with substrates, which have been temporarily stored in the stocker 24, are simultaneously gripped by the other transporter 44 of the substrate holder transport device 40 and transported to the pre-wetting tank 26, where the two substrate holders 18 are lowered to place them into the pre-wetting tank 26.

A substrate holder 18 in which is housed a substrate whose contact with the contacts 100*a* of the first contact members 100 has been determined to be poor by the sensor for sensing contact between a substrate and the electrical contacts, is kept temporarily stored in the stocker 24. This enables continuing plating operations without a stop of the apparatus despite the occurrence of poor contact between the contacts 100*a* of the first contact members 100 and the substrate held in the substrate holder 18. The substrate of poor electrical contact is not subjected to plating. Instead, the unplated substrate is returned to the substrate cassette and removed from the substrate cassette.

Next, the two substrate holders 18 loaded with the substrates are transported to the pre-soaking tank 28 in the same manner as described above. In the pre-soaking tank 28, a surface oxide film of each substrate is etched away, thereby exposing a clean metal surface. Thereafter, the substrate holders 18 loaded with the substrates are transported to the water-cleaning tank 30*a* in the same manner as described above, and the surface of each substrate is cleaned with pure water held in the water-cleaning tank 30*a*.

The two substrate holders 18 loaded with the substrates after water cleaning are transported to the plating tank 34, filled with a plating solution, in the same manner as described above, and are each suspended and held at a predetermined position in one of the plating units 38. The transporter 44 of the substrate holder transport device 40 sequentially repeats the above operation to sequentially transport substrate holders 18, each loaded with a substrate, to the plating units 38 of the plating tank 34, and suspend the substrate holders 18 in the plating units 38.

After suspending substrate holders 18 in all the plating units 38, plating of each substrate is carried out in the following manner: While circulating a plating solution in the overflow tank 36 and allowing the plating solution to overflow into the overflow tank 36, a plating voltage is applied between each substrate W and an anode (not shown) in the plating tank 34 and, at the same time, a paddle is reciprocated parallel to the surface of the substrate by the paddle drive device 46. During the plating, each substrate holder 18 is suspended and fixed with the hands 102 supported on the top of each plating unit 38, and electricity is fed from a plating power source to, e.g., a seed layer through the first contact members 100 and the second contact members 106.

After the completion of plating, the application of the plating voltage, the supply of the plating solution and the reciprocation of the paddle are stopped. Thereafter, two substrate holders 18 loaded with substrates after plating are simultaneously gripped by the transporter 44 of the substrate holder transport device 40, and are transported to the water-cleaning tank 30*b*. The surface of each substrate is cleaned by immersing the substrate in pure water held in the water-cleaning tanks 30*b*. Thereafter, the substrate holders 18 loaded with the substrates are transported to the blow tank 32, where water droplets are removed from the substrate holders 18 by air blowing. Thereafter, the substrate holders 18 loaded with the substrates are returned to the stocker 24 and are each suspended and held at a predetermined position in the stocker 24 in the same manner as described above.

The transporter 44 of the substrate holder transport device 40 sequentially repeats the above operations to sequentially return substrate holders 18, each loaded with a substrate after plating, to predetermined positions in the stocker 24 and suspend the substrate holders 18 in the stocker 24.

Two substrate holders 18 loaded with substrates after plating, which have been returned to the stocker 24, are simultaneously gripped by the other transporter 42 of the substrate holder transport device 40, and are placed on the pedestal plate 52 of the substrate attachment/detachment section 20 in the same manner as described above. The substrate holder 18 in which is housed a substrate whose contact with the contacts 100*a* of the first contact members 100 has been determined to be poor by the sensor for sensing contact between a substrate and the electrical contacts and which has been kept temporarily stored in the stocker 24, is also transported and placed on the pedestal plate 52.

The second holding member 58 of the substrate holder 18 positioned on the center side is unlocked by the locking/unlocking mechanism, and the cylinder is actuated to open the second holding member 58. As described above, the substrate W is prevented from sticking to the second holding member 58 as it opens. The substrate W after plating is then taken by the substrate transfer device 22 out of the substrate holder 18, and transported to the spin drier 16, where the substrate W is spin-dried (drained) by high-speed rotation of the spin drier 16. The dried substrate W is then returned by the substrate transfer device 22 to the cassette 10.

After or in parallel with returning the substrate, which has been taken out of the one substrate holder 18, to the cassette 10, the pedestal plate 52 is slid laterally and the other substrate is taken out of the other substrate holder 18. The substrate is then spin-dried by the spin drier 16, and the dried substrate is returned to the cassette 10.

After returning the pedestal plate 52 to the original position, the two substrate holders 18, from which the substrates have been taken out, are simultaneously gripped by the transporter 42 of the substrate holder transport device 40 and, in the same manner as described above, are returned to predetermined positions in the stocker 24. Thereafter, two substrate holders 18 loaded with substrates after plating and which have been returned to the stocker 24, are simultaneously gripped by the transporter 42 of the substrate holder transport device 40 and, in the same manner as described above, are placed on the pedestal plate 52 of the substrate attachment/detachment section 20. Thereafter, the same operations as described above are repeated.

The sequence of operations are completed when all the substrates after plating, taken out of the substrate holders 18 which have been returned to the stocker 24, are spin-dried and returned to the cassette 10.

Figure 10:
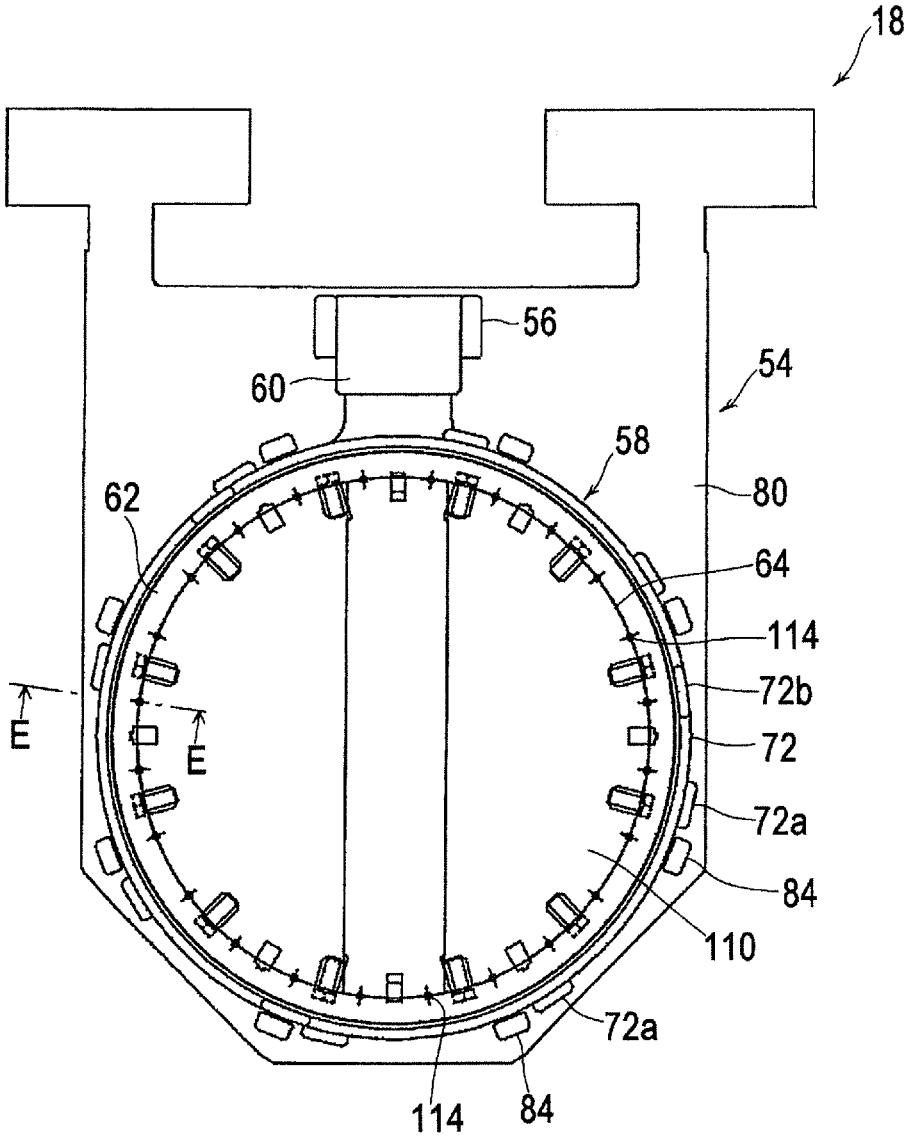
FIG. 10 is a plan view of a substrate holder according to another embodiment of the present invention.
Figure 11:
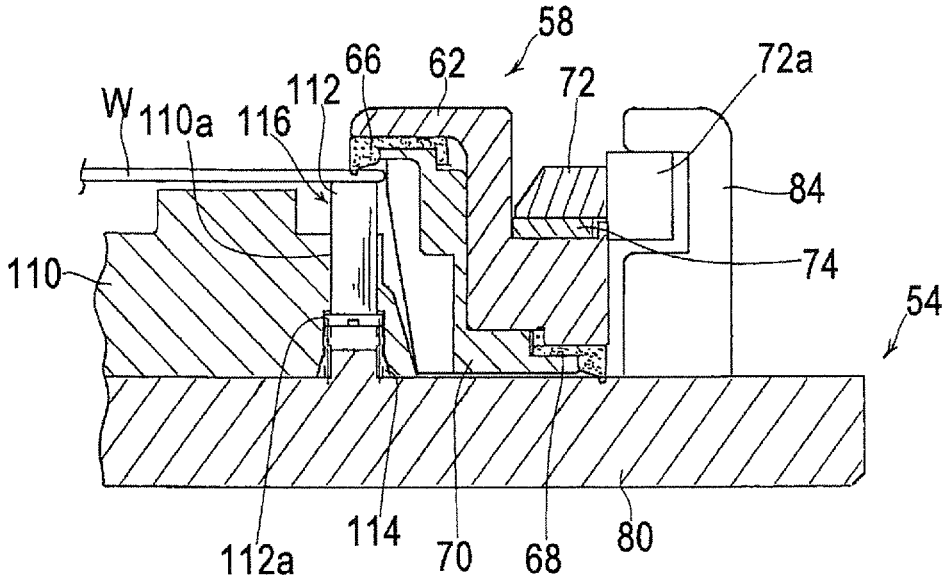
FIG. 11 is a cross-sectional view taken along the line E-E of FIG. 10.

FIG. 10 is a plan view of a substrate holder according to another embodiment of the present invention, and FIG. 11 is a cross-sectional view taken along the line E-E of FIG. 10. As shown in FIGS. 10 and 11, the first holding member 54 of the substrate holder 18 of this embodiment includes a support base 80 and a fixed base 110 secured to the support base 80. The fixed base 110 has a plurality of, for example 24, vertical through-holes 110*a* arranged at positions along the substrate sealing line 64. In each through-hole 110*a* is disposed an extendable pin 112 which is biased in a direction away from the support base 80 (upwardly) by a compression spring 114 interposed between the support base 80 and the extendable pin 112. The extendable pin 112 projects from the plane containing the top surface of the support base 110 (upwardly) so that the top end surface of the extendable pin 112 makes contact with a substrate W to support the substrate W. The construction using the extendable pins 112 and the compression springs 114 constitutes a thickness absorbing mechanism 116 in which the extendable pins 112 contract against the biasing forces (spring forces) of the compression springs 114 for a distance proportional to the thickness of a substrate W held by the substrate holder 18. A change in the thickness between substrates can thus be absorbed.

Thus, when a substrate W is held by the substrate holder 18, the distance between the support base 80 and the substrate sealing member 66 is approximately constant regardless of the thickness of the substrate W. On the other hand, as the thickness of the substrate W increases, the deformation (compression) of each compression spring 114 increases to such an extent as to approximately match the increase in the thickness of the substrate W and, accordingly, the contraction of each extendable pin 112 increases by the increase in the deformation of each compression spring 114. The amount of compression of the substrate sealing member 66 upon holding of a substrate W, having a large thickness, can therefore be decreased, making it possible to hold the substrate W while keeping the amount of compression of the substrate sealing member 66 within a certain narrow range.

Each through-hole 110*a* is stepped such that the diameter is larger on the side of the support base 80. Each extendable pin 112 is provided with a larger-diameter stopper 112*a* for contact with the step of the through-hole 110*a* to limit the movement of the extendable pin 112. An initial compression strain is thus imparted to the compression spring 114 interposed between the support base 80 and the extendable pin 112.

Also according to this embodiment, by contracting the extendable pins 112 according to the thickness of a substrate W when holding the substrate W, the amount of compression of the substrate sealing member 66 can be kept within a certain narrow range. Furthermore, deflection of the substrate W, held by the substrate holder 18, can be prevented by allowing the biasing forces (spring forces) of the plurality of extendable pins 112 to act on the substrate W at positions along the substrate sealing line 64.

While the present invention has been described with reference to preferred embodiments, it is understood that the present invention is not limited to the embodiments described above, but is capable of various changes and modifications within the scope of the inventive concept as expressed herein.

What is claimed is:

1. A substrate holder comprising:

a first holding member and a second holding member, both for detachably holding a substrate by holding a peripheral portion of the substrate therebetween, wherein the second holding member has a protruding portion which, when the substrate is held by the first holding member and the second holding member, seals the peripheral portion of the substrate along a substrate sealing line, wherein the first holding member has a support base, a movable base provided separately from the support base and having an annular support surface which is able to touch the peripheral portion of the substrate for supporting the substrate, wherein a gap is formed between the support base and the moveable base, and a thickness absorbing mechanism which, when the substrate is held by the first holding member and the second holding member, biases the substrate on the annular support surface toward the second holding member at positions along the substrate sealing line in order to absorb a change in the thickness between substrates, wherein the thickness absorbing mechanism is disposed between the support base and the movable base, and wherein the second holding member is provided with a first contact member for contact with the peripheral portion of the substrate, held between the first holding member and the second holding member, to supply electricity to the substrate, and the support base of the first holding member is provided with a second contact member connected to an external power source to supply electricity to the first contact member.

2. The substrate holder according to claim 1, wherein the thickness absorbing mechanism comprises a plurality of compression springs supporting the movable base movably with respect to the support base.

3. The substrate holder according to claim 2, wherein the first holding member is provided with a base guide mechanism for limiting the movement of the movable base with respect to the support base, said base guide mechanism having a stopper for preventing escape of the movable base from the support base.

4. The substrate holder according to claim 2, wherein the movable base of the first holding member is provided with a substrate guide for guiding the peripheral end of the substrate to position the substrate with respect to the movable base.

5. A plating apparatus comprising:

the substrate holder according to claim 1; and a plating tank for holding a plating solution therein.

6. The substrate holder according to claim 1, wherein the protruding portion is a first protruding portion, and the second holding member further has a second protruding portion which seals a gap between the support base of the first holding member and the second holding member.

7. The substrate holder according to claim 2, wherein the plurality of compression springs are arranged along the annular support surface.

8. The substrate holder according to claim 1, wherein the annular support surface extends along the peripheral portion of the substrate when the substrate is held by the first holding member and the second holding member.

* * * * *